US005601969A

United States Patent [19]

Verbeeck

[11] Patent Number: 5,601,969

[45] **Date of Patent: *Feb. 11, 1997**

[54] PREPARATION OF TABULAR EMULSION GRAINS RICH IN CHLORIDE

[75] Inventor: Ann L. Verbeeck, Begijnendijk, Belgium

[73] Assignee: Agfa-Gevaert, N.V., Mortsel, Belgium

[ * ] Notice: The term of this patent shall not extend beyond the expiration date of Pat. No. 5,286,621.

[21] Appl. No.: 774,188

[22] Filed: Oct. 10, 1991

[30] Foreign Application Priority Data

Oct. 19, 1990 [EP] European Pat. Off. ..... 90202792

[51] Int. Cl.[6] ..... G03C 1/07; G03C 1/035; G03C 1/005

[52] U.S. Cl. ..... 430/569; 430/567; 430/614; 430/615

[58] Field of Search ..... 430/569, 614, 430/615, 562

[56] References Cited

U.S. PATENT DOCUMENTS

| | | | |
|---|---|---|---|
| 3,477,852 | 11/1969 | Allentoff et al. | 430/567 |
| 4,334,012 | 6/1982 | Mignot | 430/569 |
| 4,400,463 | 8/1983 | Maskasky | 430/569 |
| 4,713,323 | 12/1987 | Maskasky | 430/569 |
| 4,801,523 | 1/1989 | Tufano | 430/614 |
| 4,804,621 | 2/1989 | Tufano et al. | 430/569 |
| 4,859,580 | 8/1989 | Aono et al. | 430/615 |
| 5,176,991 | 1/1993 | Jones et al. | 430/569 |
| 5,176,992 | 1/1993 | Maskasky et al. | 430/569 |
| 5,178,997 | 1/1993 | Maskasky | 430/569 |
| 5,178,998 | 1/1993 | Maskasky et al. | 430/569 |
| 5,183,732 | 2/1993 | Maskasky | 430/569 |
| 5,185,239 | 2/1993 | Maskasky | 430/569 |
| 5,286,621 | 2/1994 | Verbeeck | 430/567 |
| 5,411,852 | 5/1995 | Maskasky | 430/569 |

*Primary Examiner*—Mark F. Huff
*Attorney, Agent, or Firm*—Breiner & Breiner

[57] ABSTRACT

A method for the preparation of silver halide tabular emulsion grains, containing at least 75 % chloride, wherein at least 50 % of the total projected area of all the grains is provided by the tabular grains, and wherein the tabular grains exhibit an average aspect ratio of at least 5:1, an average thickness not greater than 0.5 micron and an average diameter of at least 0.6 micron. The method comprises preparing a dispersion medium containing a gelatino-peptizer, and a compound

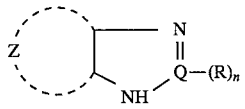

(Ia)

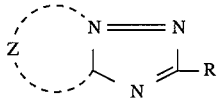

(Ib)

wherein Z represents the atoms necessary to form a fused on aromatic carbocyclic or heterocyclic, unsubstituted or substituted ring, e.g., substituted with alkyl, alkenyl, aryl, alkoxy, hydroxy, mercapto, carboxy, amino or halogen, R is hydrogen or a substituent as defined for ring Z; n is 1 or 0, and Q represents carbon in which case n=1, or Q represents nitrogen, in which latter case n =0; in a concentration ranging from $10^{-4}$ to $10^{-2}$ molar. The pH of the medium is adjusted to between 5.0 and 9.0 and to a pCl between 1.0 and 2.0 by means of a chloride ions providing salt;

performing a silver halide precipitation comprising at least one double jet step by introducing in the dispersion medium at least one solution containing chloride ions and at least one solution containing silver ions in such a way that pCl is maintained between 1.0 and 2.0, pH is maintained between 5.0 and 9.0 and the concentration of compound (Ia) or (Ib) is maintained between $10^{-4}$ molar and $10^{-2}$ molar; and removing excess of soluble salts by a wash technique performed at a pH value comprised between 4.0 and 9.0.

12 Claims, No Drawings

PREPARATION OF TABULAR EMULSION GRAINS RICH IN CHLORIDE

FIELD OF THE INVENTION

The present invention relates to the preparation of tabular silver halide emulsion grains rich in chloride and to photographic materials containing said grains.

BACKGROUND OF THE INVENTION

Tabular grains are known in the photographic art for quite some time. As early as 1961 Berry et al described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes Bogg U.S. Pat. No. 4,063,951, Lewis U.S. Pat No. 4,067,739 and Maternaghan U.S. Pat. No. 4,150,994, U.S. Pat. No. 4,184,877 and U.S. Pat. No. 4,184,878. However the tabular grains described herein cannot be regarded as showing a high diameter to thickness ratio, commonly termed aspect ratio. In a number of U.S. applications filed in 1981 and issued in 1984 tabular grains with high aspect ratio and their advantages in photographic applications are described. So Wilgus U.S. Pat. No. 4,434,226 discloses tabular silver bromoiodide grains having a thickness less than 0.3 micron, a diameter of at least 0.6 micron and an average aspect ratio greater than 8:1 and accounting for at least 50 percent of the total projected area of all the emulsion grains. Kofron U.S. Pat. No. 4,439,520 discloses similar grains which are spectrally sensitized. Abbott U.S. Pat. No. 4,425,425 describes radiographic materials containing tabular grains with aspect ratio of at least 8:1 and Abbott U.S. Pat. No. 4,425,426 discloses similar grains with an aspect ratio between 5:1 and 8:1. Solberg U.S. Pat. No. 4,433,048 protects tabular silver bromoiodide grains with inhomogeneously distributed iodide. A survey on high aspect ratio silver halide emulsions appeared in Research Disclosure, Vol 225, Jan 1983, item 22534.

High aspect ratio tabular grains exhibit several pronounced photographic advantages. Thanks to their particular morphology greater amounts of spectral sensitizers can be adsorbed per mole silver halide compared to classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties again compared to conventional globular emulsion grains. In color negative materials the conventional sequence of the light sensitive layers can be altered and the yellow filter layer can be omitted. In developed black-and-white images high covering power is obtained even at high hardening levels; alternatively reduced silver halide coverages can be achieved if wanted resulting again in improved sharpness. In double coated radiographic materials the presence of tabular grains reduces the so-called cross-over which is the dominant factor for sharpness in such materials.

The above cited references on tabular grains are mainly concerned with high sensitive silver bromide or silver iodobromide emulsions. However in a lot of photographic applications high sensitivity is of less importance. In these cases the use of chloride rich emulsions is advantageous e.g. thanks to their higher development and fixing rates. Typical examples include graphic arts materials, duplicating materials, radiographic hard-copy materials, diffusion transfer reversal materials and black-and-white or color print materials. So it would be interesting to try to combine the advantages of chloride rich emulsions with the advantages of tabular grain structure.

When using conventional precipitation conditions chloride rich emulsion grains show a cubic morphology with (100) crystal faces. It is known that to alter this crystallographic habit so-called "growth modifiers" or "crystal habit modifiers" are required. Klein and Moisar, in Berichte der Bunsengeselschaft 67 (4), p. 349–355, report inhibition of the growth rate of silver chloride by purine bases such as adenine. Claes et al., J. Photogr. Sci. Vol. 21 (1973), p. 39–50, showed that growth modifiers can be used to precipitate octahedral and rhombic dodecahedral silver chloride crystals and they attributed the crystal habit modification to variations in surface hydration caused by those additives; typical examples of these modifiers included adenine, thiourea, hypoxanthine, benzimidazole and benzothiazole derivatives. The mechanism of the growth modifying action of adenine was studied in detail by Szucs in J. Signal AM Vol. 6 (1978) No 5 p. 381–405.

In more recent patent applications tabular chloride rich emulsion grains are contemplated. So Wey U.S. Pat. No. 4,399,215 discloses tabular silver chloride with an aspect ratio of at least 8:1 and parallel (111) major crystal faces. Precipitation conditions include the use of ammonia. Rather thick tabular grains are obtained. Wey U.S. Pat. No. 4,414,306 discloses tabular silver chlorobromide grains with at least an annular region where the molar ratio of chloride to bromide ranges up to 2:3.

In U.S. Pat. No. 4,400,463 Maskasky describes the preparation of a new crystallographic form of tabular silver halide grains rich in chloride by performing the precipitation in the presence of a special peptizer having a thioether linkage and an aminoazaindene growth modifier. A preferred growth modifier is adenine. Control example Emulsion 2 describes the failure to produce tabular grains using adenine when the special peptizer is absent and only conventional gelatin is present. In this example the reaction vessel contained a rather high amount of chloride (0.5 molar) before the start of the precipitation and pH was adjusted to 3.0.

Maskasky U.S. Pat. No. 4,713,323 discloses the preparation of thin tabular grains (less than 0.35 micron) by a precipitation technique wherein at least a molar concentration of chloride ion is present in the reaction vessel at the start and oxidized gelatin is used containing less than 30 micromoles of methionine per gram. In a preferred embodiment, illustrated by examples, a growth modifier e.g. an aminoazaindene like adenine is used. Control Example 1D describes the failure to produce a tabular AgClBr (1.0% Br) emulsion in the presence of adenine but using conventional gelatin instead of oxidized gelatin. In this case the reaction vessel contained 0.5 molar chloride ions and pH was adjusted to 4.0.

Tufano U.S. Pat. No. 4,804,621 describes a process for preparing chloride rich tabular grains in the presence of aminoazapyridine growth modifiers represented by a general formula of which adenine and derivatives are excluded. A preferred compound is e.g. 4-aminopyrazolo[3,4, d]pyrimidine. Example Control 2 demonstrates the failure to prepare tabular grains using adenine as a growth modifier. In this example pCl was maintained at 0.7 and pH at 4.0.

It is an object of the present invention to provide a new method of preparing tabular silver halide grains rich in chloride.

It is a further object of the present invention to provide photographic materials which contain tabular grains prepared by this new method.

Other objects will become apparent from the description hereafter.

SUMMARY OF THE INVENTION

It was found quite unexpectedly that silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, could be prepared by a process comprising the following steps:

preparing a dispersion medium containing a gelatino-peptizer, and a heterocyclic compound according to general formula (Ia) or (Ib), or one of their tautomeric forms, in a concentration ranging from $10^{-4}$ to $10^{-2}$ molar, said medium being adjusted to a pH between 5.0 and 9.0 and to a pCl between 1.0 and 2.0 by means of a chloride ions providing salt; formula (Ia) an (Ib) are:

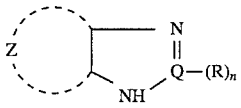

(Ia)

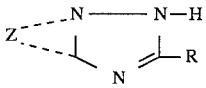

(Ib)

wherein Z represents the atoms necessary to form a fused on aromatic carbocyclic or heterocyclic, unsubstituted or substituted ring, e.g. substituted with alkyl, alkenyl, aryl, alkoxy, hydroxy, mercapto, carboxy, amino or halogen, R is hydrogen or a substituent as defined for ring Z; n is 1 or 0, and Q represents carbon in which case n=1, or Q represents nitrogen, in which latter case n=0.

performing a silver halide precipitation comprising at least one double jet step by introducing in said dispersion medium at least one solution containing chloride ions and at least one solution containing silver ions in such a way that pCl is maintained between 1.0 and 2.0, pH is maintained between 5.0 an 9.0 and the concentration of compound (Ia) or (Ib) is maintained between $10^{-4}$ molar and $10^{-2}$ molar;

removing excess of soluble salts by a wash technique performed at a pH value comprised between 4.0 and 9.0; this wash technique is preferably ultrafiltration.

In a preferred embodiment the heterocyclic compound according to general formula (Ia) or (Ib) is an adenine derivative according to general formula (II).

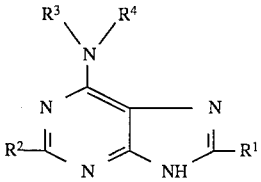

(II)

wherein each of $R^1$ and $R^2$ represents hydrogen, alkyl, alkenyl, aryl, alkoxy, hydroxy, mercapto, carboxy, amino or halogen, and each of $R^3$ and $R^4$ represents hydrogen or alkyl.

In a still more preferred embodiment said adenine derivative is adenine itself.

It was surprising to find that specific precipitation conditions could be established wherein said compounds according to general formula (I) or (II), e.g. adenine, could be successfully used as crystal growth modifier to produce chloride rich tabular grains while prior art in several instances failed to do so.

DETAILED DESCRIPTION OF THE PRESENT INVENTION

In the execution of the present invention there is no need for the use of a special oxidized gelatin or the presence of a synthetic peptizer. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. Preferably a gelatin/silver halide ratio ranging from 0.3 to 1.0 is then obtained.

Although the precipitation in connection with the present invention can be principally performed by one double jet step it is preferred to perform a sequence of a nucleation step and at least one growth step. Of the total silver precipitated preferably 0.5% to 5.0% is added during said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater than at the start of the growth step. These flow rates can be monitored by e.g. magnetic valves. It is crucial for the successful execution of the present invention that before the start and during the different stages of the precipitation the pCl is maintained between 1.0 and 2.0, preferably between 1.0 and 1.5, and pH is maintained between 5.0 and 9.0, preferably between 5.5 and 7.0. Before the start of the precipitation the concentration in the dispersion medium of compound (Ia) or (Ib) according to the present invention is established between $10^{-4}$ and $10^{-2}$ molar and is maintained during precipitation between those values. This can be achieved by introducing a sufficient amount of compound (Ia) or (Ib) in the dispersion medium before the start of the precipitation or by introducing supplemental compound (Ia) or compound (Ib) during the precipitation or during intermediate physical ripening steps. This extra amount of compound (Ia) or compound (Ib) can be added in one or more of the halide or silver salt solutions or in one or more separate solutions; preferably the supplemental compound (Ia) or compound (Ib) is present in a halide solution.

As stated above, in a preferred embodiment of the present invention the heterocyclic compound according to formula (Ia) or (Ib) is an adenine derivative according to general formula (II).

In a still more preferred embodiment said adenine derivative according to general formula (II) is adenine itself (compound Ia1):

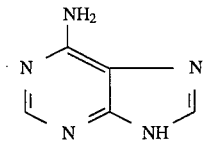

(Ia-1)

Specific useful compounds, others than adenine, for use in accordance with the present invention include following substances:

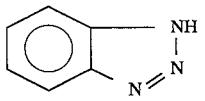

(Ia-2)

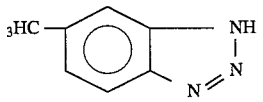

(Ia-3)

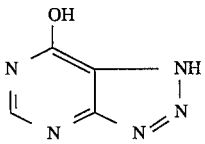

(Ia-4)

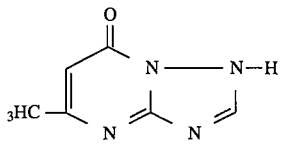

(Ib-1)

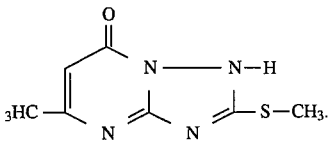

(Ib-2)

After completion of the precipitation a wash technique in order to remove the excess of soluble salts is applied at a pH value which can vary during washing but remains comprised between 4.0 and 9.0, preferably between 5.0 and 7.0. Flocculation by polymeric reagentia at a pH value below 4.0, followed by redispersion, is specifically excluded while it is believed that such a procedure degrades the tabular structure of the grain. Preferably the emulsion is washed by diafiltration by means of a semipermeable membrane, also called ultrafiltration. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, pH and pAg are the same as at the end of the precipitation without any adjustment.

It is specifically contemplated that up to 25 molar percent of bromide or both bromide and iodide can be incorporated in the tabular grains of the present invention. This can be achieved by mixing a soluble bromide and/or a soluble iodide salt in one or more of the halide solutions up to 25 mole % of the total halide; however preferably this incorporation is performed by adding this soluble bromide and/or iodide salt after formation of substantially pure silver chloride tabular grains. Due to the lower solubility of their corresponding silver salts bromide and iodide ions are able to displace chloride from the grain, a technique known in the art as conversion.

Two or more types of tabular silver halide emulsions that have been prepared differently can be mixed for forming a photographic emulsion for use in accordance with the present invention.

The size distribution of the tabular silver halide particles of the photographic emulsions to be used according to the present invention can be monodisperse or heterodisperse.

The photographic tabular grains in connection with the present invention can be used in various types of photographic elements. Because of their chloride rich character they are preferably used for those applications which do not require extreme high sensitivity. Preferred embodiments include graphic arts e.g. recording materials for the output of scanners, phototypesetters and imagesetters, duplicating materials, radiographic hard-copy materials, diffusion transfer materials and black-and-white or colour print materials which produce prints starting from negatives in amateur or professional still photography or prints for cinematographic exhibition.

The photographic element can contain one single emulsion layer, as it is the case for many applications, or it can be built up by two or even more emulsion layers. In the case of color photography the material contains blue, green and red sensitive layers each of which can be single or multiple. Beside the light sensitive emulsion layer(s) the photographic material can contain several non-light sensitive layers, e.g. a protective layer, one or more backing layers, one or more subbing layers, and one or more intermediate layers e.g. filter layers.

The tabular silver halide emulsions in connection with the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by affecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripenets or by means of reductors e.g. tin compounds as described in GB 789,823, amines, hydrazine derivatives, formamidine-sulphinic acids, and silane compounds.

The tabular silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534. An especially preferred green sensitizer in connection with the present invention is represented by following formula:

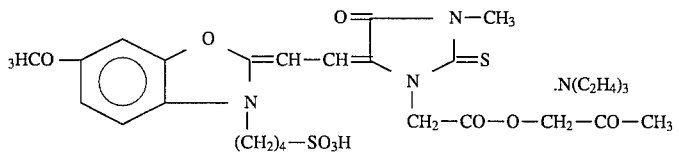

In classical emulsion preparation spectral sensitization traditionally follows the completion of chemical sensitization. However, in connection with tabular grains, it is specifically considered that spectral sensitization can occur simultaneously with or even precede completely the chemical sensitization step. For example, Maskasky U.S. Ser. No 431,855, titled CONTROLLED SITE EPITAXIAL SENSITIZATION discloses the chemical sensitization after spectral sensitization at one or more ordered discrete edge sites of tabular grains. This can be done with the tabular chloride rich emulsions of the present invention.

The silver halide emulsion layer(s) in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75–39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure N° 17843 (1978), Chapter VI.

In the preferred embodiment of a photographic material for colour print purposes, the usual ingredients specific for colour materials can be present e.g. colour couplers, couplers bearing a releasable photographic useful group and scavengers for oxidized developer These typical ingredients for colour materials can be soluble or added in dispersed form, e.g. with the aid of so-called oilformers or they can be added in polymeric latex form.

The gelatin binder of the photographic elements can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration. Preferred surface-active coating agents are compounds containing perfluorinated alkyl groups.

Development acceleration can be accomplished with the aid of various compounds, preferably polyalkylene derivatives having a molecular weight of at least 400 such as those described in e.g. U.S. Pat. No. 3,038,805 - U.S. Pat. No. 4,038,075- U.S. Pat. No. 4,292,400.

The photographic element of the present invention may further comprise various other additives such as e.g. compounds improving the dimensional stability of the photographic element, UV-absorbers, spacing agents and plasticizers.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, mathacrylic acids, Alpha-Beta-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455. UV-absorbers are especially useful in colour print materials where they prevent the fading by light of the colour images formed after processing.

Spacing agents can be present of which, in general, the average particle size is comprised between 0.2 and 10 micron. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

As stated above the photographic material can contain several non light sensitive layers, e.g. an anti-stress top layer, one or more backing layers, and one or more intermediate layers eventually containing filter- or antihalation dyes that absorb scattering light and thus promote the image sharpness. Suitable light-absorbing dyes are described in e.g. U.S. Pat. No. 4,092,168, U.S. Pat. No. 4,311,787, DE 2,453,217, and GB 7,907,440. One or more backing layers can be provided at the non-light sensitive side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in the preferred embodiment of materials for graphic arts so-called rapid access developers can be used; alternatively so-called lith developers or the more recent "hard dot rapid access" developers can be used depending on the specific composition and use of the photographic element. Preferably an automatically operating processing apparatus is used provided with a system for automatic regeneration of the processing solutions.

The following examples illustrate the invention without however limiting it thereto.

EXAMPLE 1

The following solutions were prepared:

2 l of a dispersion medium (C) containing 0.2 moles of sodium chloride (pCl=1.0), 1 g of inert gelatin and 90 mg of adenine; temperature was established at 30° C. and pH was adjusted to 5.8;

a 2.94 molar silver nitrate solution (A);

a 2.94 molar sodium chloride solution (B1);

a 2.94 molar sodium chloride and 0.0013 molar adenine solution (B2).

a 3.94 molar sodium chloride solution (B3)

A nucleation step was performed by introducing solution A and solution B1 simultaneously in dispersion medium C both at a flow rate of 20 ml/min during 30 seconds. After a physical ripening time of 15 min during which the temperature was raised to 70° C. 74 g of gelatin, 985 ml of water and 15 ml of solution B3 were added and the mixture was stirred for an additional 5 minutes. Then a growth step was performed by introducing by a double jet during 3960 seconds solution A starting at a flow rate of 5 ml/min and linearly increasing the flow rate to an end value of 25 ml/min, and solution B2 at an increasing flow rate as to maintain a constant milli-Volt value, measured by a silver electrode versus calomel, of +88 mV corresponding to a pCl of 1.30.

The dipersion medium was cooled down to about 60° C. and without adjustment of pH and pAg concentrated by ultrafiltration to about 2.5 l by means of a dialysis apparatus. Soluble salts were removed thereafter by diafiltration while keeping the volume constant by the addition of pure water in countercurrent. The procedure was monitored by conductivity measurements until an end value of about 5 mS was reached.

The thus obtained pure silver chloride tabular emulsion showed following grain characteristics: average diameter= 1.65 micron, average thickness =0.18 micron, average aspect ratio=9:1 and average sphere equivalent diameter =0.77 micron. The diameter of the grain was defined as the diameter of the circle having an area equal to the projected area of the grain as viewed in photomicrograph or electron micrograph. The sphere equivalent diameter was defined as the diameter of a hypothetical spherical grain with the same volume as the corresponding tabular grain.

EXAMPLE 2

The following solutions were prepared:

2 l of a dispersion medium (C) containing 0.047 moles of sodium chloride (pCl=1.6), 1 g of inert gelatin and 180 mg of adenine; temperature was established at 30° C. and pH was adjusted to 5.8;

a 2.94 molar silver nitrate solution (A);

a 2.94 molar sodium chloride solution (B).

A nucleation step was performed by introducing solution A and solution B simultaneously in dispersion medium C both at a flow rate of 20 ml/min during 120 seconds. After a physical ripening time of 15 min during which the temperature is raised to 70° C. 74 g of gelatin and 1 l of water was added and the mixture was stirred for an additional 5 minutes. Then a growth step was performed by introducing by a double jet during 3840 seconds solution A starting at a flow rate of 5 ml/min and linearly increasing the flow rate to an end value of 25 ml/min, and solution B at an increasing flow rate as to maintain a constant milli-Volt value, measured by a silver electrode versus calomel, of +113 mV corresponding to a pCl of 1.65. The emulsion was concentrated and washed by ultrafiltration similar to example 1.

The thus obtained pure silver chloride tabular emulsion showed following grain characteristics: average diameter =0.66 micron, average thickness=0.22 micron, average aspect ratio=3:1 and average sphere equivalent diameter =0.505 micron.

EXAMPLE 3

The following solutions were prepared:

2 l of a dispersion medium (C) containing 0.29 moles of sodium chloride, 1 g of inert gelatin and 180 mg of adenine; temperature was established at and pH was adjusted to 5.8;

a 2.94 molar silver nitrate solution (A);

a 2.94 molar sodium chloride solution (B1);

a 2.94 molar sodium chloride and 0.0013 molar adenine solution (B2);

a 1.76 molar sodium chloride and 1.18 molar potassium-bromide solution (B3).

A nucleation step was performed by introducing solution A and solution B1 simultaneously in dispersion medium C both at a flow rate of 20 ml/min during 30 seconds. After a physical ripening time of 15 min during which the temperature was raised to 70° C. 74 g of gelatin and 1 l of water was added and the mixture was stirred for an additional 5 minutes. Then a first growth step was performed by introducing by a double jet during 3455 seconds solution A starting at a flow rate of 5 ml/min and linearly increasing the flow rate to an end value of 22.5 ml/min, and solution B2 at an increasing flow rate as to maintain a constant milli-Volt value, measured by a silver electrode versus calomel, of +92 mV. Then a second growth step was performed by introducing by a double jet during 506 seconds solution A starting at a flow rate of 22.5 ml/min and linearly increasing the flow rate to an end value of 25.0 ml/min, and solution B3 at an increasing flow rate as to maintain a constant milli-Volt value of +92 mV. The emulsion was concentrated and washed by ultrafiltration similar to example 1.

The thus obtained $AgCl_{0.92}Br_{0.08}$ tabular emulsion showed following grain characteristics: average diameter= 1.35 micron, average thickness=0.15 micron, average aspect ratio=8.0 and average sphere equivalent diameter =0.75 micron.

EXAMPLE 4

Example 4 was identical to example 1 with the exception that the B3 solution consisted of a 2.65 molar sodium chloride and 0.29 molar potassium bromide solution.

The thus obtained $AgCl_{0.98}Br_{0.02}$ tabular emulsion showed following grain characteristics: average diameter= 1.28 micron, average thickness=0.15 micron, average aspect ratio=8.0 and average sphere equivalent diameter=0.74 micron.

EXAMPLE 5

The following solutions were prepared:

disperion medium (C) containing 0.28 moles of sodium chloride, 14 g of inert gelatin, 360 mg of adenine and 2680 ml of water; temperature was established at 60° C. and pH was adjusted to 5.0;

2.94 molar silver nitrate solution (A);

2.94 molar sodium chloride solution (B1);

2.94 molar potassium bromide solution (B2);

3.94 molar sodium chloride solution (B3).

A nucleation step was performed by introducing solution A and solution B1 simultaneously in dispersion medium C both at a flow rate of 10 ml/min during 60 seconds. After a physical ripening time of 15 min 61 g of gelatin, 6 ml of solution B3 and 244 ml of water was added and the mixture was stirred for an additional 5 minutes. Then a first growth step was performed by introducing by a double jet during 3013 seconds solution A starting at a flow rate of ml/min and linearly increasing the flow rate to an end value of 14.5 ml/min, and solution B1 at sn increasing flow rate as to maintain a constant milli-Volt value, measured by s silver electrode versus calomel, of +68 mV. Thereupon a conversion step was performed by adding 100 ml of solution B2 and the mixture was stirred for an additional 15 minutes. Then a second growth step was performed by introducing by a double jet during 1739 seconds solution A starting at a flow rate of 14.5 ml/min and linearly increasing the flow rate to an end value of 20.0 ml/min, and solution B1 at an increasing flow rate as to maintain a constant milli-Volt value of +68 mV. The emulsion was concentrated and washed by ultrafiltration similar to example 1.

The thus obtained $AgCl_{0.90}Br_{0.10}$ tabular emulsion showed following grain characteristics: average diameter= 1.87 micron, average thickness=0.24 micron, average aspect ratio=7.8 : 1 and average sphere equivalent diameter=0.99 micron.

EXAMPLE 6

Example 6 was identical with example 5 with the exception that in the conversion step the silver bromide solution B2 was replaced by 40 ml of a 2.94 molar potassium iodide solution.

The thus obtained $AGCl_{0.96}I_{0.04}$ tabular emulsion showed following grain characteristics: average diameter=1.33 micron, average thickness=0.19 micron, average aspect ratio=7:1 and average sphere equivalent diameter =0.78 micron.

EXAMPLE 7

The following solutions were prepared:

1 l of a dispersion (C) medium was prepared containing 0.01 moles of potassium bromide, 5 g of inert gelatin and $10^{-3}$ moles of compound (Ib-2); temperature was established at 30° C. and pH was adjusted to 5.8;

2.94 molar silver nitrate solution (A);

2.94 molar sodium chloride solution (B);

A nucleation step was performed by introducing solution A and solution B simultaneously in dispersion medium C both at a flow rate of 20 ml/min during 30 seconds. After a physical ripening time of 15 min during which the temperature was raised to 70° C. 45 g of gelatin and 1 l of water were added and the mixture was stirred for an additional 5 minutes. Then a growth step was performed by introducing by a double jet during 4752 seconds solution A starting at a flow rate of 5 ml/min and linearly increasing the flow rate to an end value of 20 ml/min and solution B at an increasing flow rate as to maintain a constant silver potential, measured by a silver electrode versus calomel, of +68 mill-Volt. The emulsion was concentrated and washed by ultrafiltration similar to example 1.

The thus obtained $AgCl_{0.96}$ $Br_{0.034}$ tabular emulsion showed following grain characteristics: average diameter=

1.18 micron, average thickness=0.17 micron, average aspect ratio=7.0.

EXAMPLE 8

A globular pure silver chloride emulsion (control emulsion A) was prepared by a conventional double jet technique showing a sphere equivalent diameter of 0.8 micron. A tabular pure silver chloride emulsion B was prepared according to the invention in a way similar to example 1 showing the same sphere equivalent diameter of about 0.8 micron. Both emulsions were chemically sensitized to an optimal fog/sensitivity ratio using conventional sulphur and gold containing sensitizing agents. Then the emulsions were orthochromatically sensitized using 0.45 mmole/mole silver halide of a compound represented by following chemical formula:

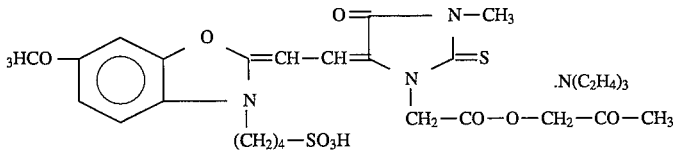

The emulsions were coated at 10 g Ag/m$^2$ expressed as $AgNO_3$ using conventional coating aids. The finished emulsion samples were exposed using tungsten light and a continuous ton wedge and the respective sensitivities were measured at desity 0.2 above fog. The sensivity difference is expressed as relative log Et difference and illustrated by table 1 :

TABLE 1

| emulsion sample | sensitivity |
|---|---|
| A (control) | ref. |
| B (invention) | +0.66 log Et |

It is clear from table 1 that the tabular emulsion in accordance with the present invention shows a distinct advantage in sensitivity compared to the globular control emulsion.

I claim:

1. Method for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, comprising the following steps:

preparing a dispersion medium containing a gelatino-peptizer, and a heterocyclic compound according to general formula (Ia) or (Ib) in a concentration ranging from $10^{-4}$ to $10^{-2}$ molar, said medium being adjusted to a pH between 5.0 and 9.0 and to a pCl between 1.0 and 2.0 by means of a chloride ions providing salt; formula (Ia) and (Ib) are:

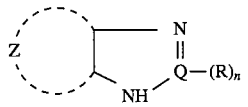

(Ia)

-continued

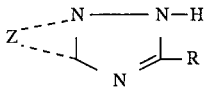

(Ib)

wherein Z represents the atoms necessary to form a fused on aromatic carbocyclic or heterocyclic ring;

R is hydrogen or alkyl, alkenyl, aryl, alkoxy, hydroxy, mercapto, carboxy, amino or halogen; n is 1 or 0, and Q represents carbon in which case n=1, or Q represents nitrogen, in which latter case n=0.

performing a silver halide precipitation comprising at least one double jet step by introducing in said dispersion medium at least one solution containing chloride ions and at least one solution containing silver ions in such a way that pCl is maintained between 1.0 and 2.0, pH is maintained between 5.0 an 9.0 and the concentration of compound (Ia) or (Ib) is maintained between $10^{-4}$ molar and $10^{-2}$ molar;

removing excess of soluble salts by a wash technique performed at a pH value comprised between 4.0 and 9.0.

2. Method according to claim 1 wherein said compound (Ia) or compound (Ib) is an adenine derivative according to general formula (II):

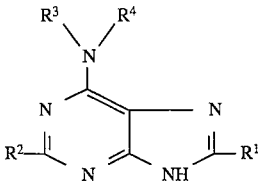

(II)

wherein each of $R^1$ and $R^2$ represents hydrogen, alkyl, alkenyl, aryl, alkoxy, hydroxy, mercapto, carboxy, amino or halogen, and each of $R^3$ and $R^4$ represents hydrogen or alkyl.

3. Method according to claim 2 wherein said adenine derivative according to general formula (II) is adenine itself.

4. Method according to claim 1 wherein part of said compound (Ia) or (Ib) is added by incorporating it in one or more halide solutions.

5. Method according to claim claim 1 wherein part of said compound (Ia) or (Ib) is added in one or more separate solutions.

6. Method according to claim 1 wherein said silver halide precipitation comprises a crystal nucleation step and at least one double jet crystal growth step.

7. Method according to claim 6 wherein said at least one double jet crystal growth step is performed by linearly increasing the flow rate of the added halide ion and silver ion solutions.

8. Method of preparation of silver halide tabular emulsion grains according to claim 1 wherein up to maximally 25 molar % of the total halide content is made up of bromide and/or iodide built in by a conversion technique.

9. Method of preparation of silver halide tabular emulsion grains according to claim 1 wherein said wash technique is ultrafiltration.

10. Photographic material comprising a support and at least one emulsion layer containing tabular silver halide emulsion grains prepared according to the method of claim 1.

11. Method for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, comprising the following steps:

preparing a dispersion medium containing a gelatino-peptizer, and a heterocyclic compound according to general formula x in a concentration ranging from $10^{-4}$ to $10^{-2}$ molar, said medium being adjusted to a pH between 5.0 and 9.0 and to a pCl between 1.0 and 2.0 by means of a chloride ions providing salt; formula x being a member of the group consisting of

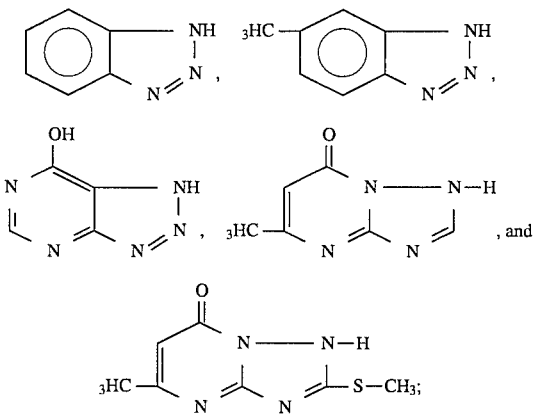

performing a silver halide precipitation comprising at least one double jet step by introducing in said dispersion medium at least one solution containing chloride ions and at least one solution containing silver ions in such a way that pCl is maintained between 1.0 and 2.0, pH is maintained between 5.0 and 9.0 and the concentration of compound x is maintained between $10^{-4}$ and $10^{-2}$ molar;

removing excess of soluble salts by a wash technique performed at a pH value comprised between 4.0 and 9.0.

12. Method for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, comprising the following steps:

preparing a dispersion medium containing a gelatino-peptizer, and a heterocyclic compound according to general formula x in a concentration ranging from $10^{-4}$ and $10^{-2}$ molar, said medium being adjusted to a pH between 5.0 and 9.0 and to a pCl between 1.0 and 2.0 by means of a chloride ions providing salt; formula x being:

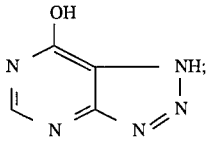

performing a silver halide precipitation comprising at least one double jet step by introducing in said dispersion medium at least one solution containing chloride ions and at least one solution containing silver ions in such a way that pCl is maintained between 1.0 and 2.0, pH is maintained between 5.0 and 9.0 and the concentration of compound x is maintained between $10^{-4}$ and $10^{-2}$ molar;

removing excess of soluble salts by a wash technique performed at a pH value comprised between 4.0 and 9.0.

* * * * *